US010730532B2

(12) United States Patent
Mueller

(10) Patent No.: US 10,730,532 B2
(45) Date of Patent: Aug. 4, 2020

(54) TRACK MAINTENANCE MACHINE

(71) Applicant: PLASSER & THEURER EXPORT VON BAHNBAUMASCHINEN GESELLSCHAFT M.B.H., Vienna (AT)

(72) Inventor: Michael Mueller, Linz (AT)

(73) Assignee: Plasser & Theurer Export von Bahnbaumaschinen m.b.H., Vienna (AT)

( * ) Notice: Subject to any disclaimer, the term of this patent is extended or adjusted under 35 U.S.C. 154(b) by 170 days.

(21) Appl. No.: 15/752,715

(22) PCT Filed: Jul. 19, 2016

(86) PCT No.: PCT/EP2016/001260
§ 371 (c)(1),
(2) Date: Feb. 14, 2018

(87) PCT Pub. No.: WO2017/028942
PCT Pub. Date: Feb. 23, 2017

(65) Prior Publication Data

US 2018/0237036 A1 Aug. 23, 2018

(30) Foreign Application Priority Data

Aug. 14, 2015 (AT) ..... A 536/2015

(51) Int. Cl.

| | |
|---|---|
| ***B61C 7/04*** | (2006.01) |
| ***E01B 27/17*** | (2006.01) |
| ***B61C 9/24*** | (2006.01) |
| ***B61C 3/02*** | (2006.01) |
| ***B61C 9/14*** | (2006.01) |
| ***B61C 9/50*** | (2006.01) |
| *E01B 29/44* | (2006.01) |

(52) U.S. Cl.
CPC ..... *B61C 7/04* (2013.01); *B61C 3/02* (2013.01); *B61C 9/14* (2013.01); *B61C 9/24* (2013.01); *B61C 9/50* (2013.01); *E01B 27/17* (2013.01); *E01B 29/44* (2013.01); *Y10S 903/93* (2013.01)

(58) Field of Classification Search
CPC ... B61C 7/00; B61C 7/04; E01B 27/00; E01B 29/00; E01B 31/00; E01B 31/02
See application file for complete search history.

(56) References Cited

U.S. PATENT DOCUMENTS 4,929,816 A * 5/1990 Theurer ..... B23K 11/0073 219/100
2010/0155372 A1 6/2010 Battisti et al.

FOREIGN PATENT DOCUMENTS

| | | | | |
|---|---|---|---|---|
| DE | 1179974 B | 10/1964 | | |
| EP | 1849676 A2 * | 10/2007 | ..... | B61C 9/08 |
| EP | 1849676 A2 | 10/2007 | | |
| WO | 2006063651 A1 | 6/2006 | | |

* cited by examiner

*Primary Examiner* — Robert J McCarry, Jr.
(74) *Attorney, Agent, or Firm* — Laurence A. Greenberg; Werner H. Stemer; Ralph E. Locher

(57) ABSTRACT

A track maintenance machine includes a combustion engine mechanically connected by a drive shaft to an electric generator/motor unit. The electric generator/motor unit is connected by a mechanical drive unit to a hydraulic pump. A power accumulator is connected by an electrical supply line to the generator/motor unit and to drives which can be actuated electrically. It is thus possible to mainly electrically supply all of the drives.

2 Claims, 1 Drawing Sheet

Fig.1
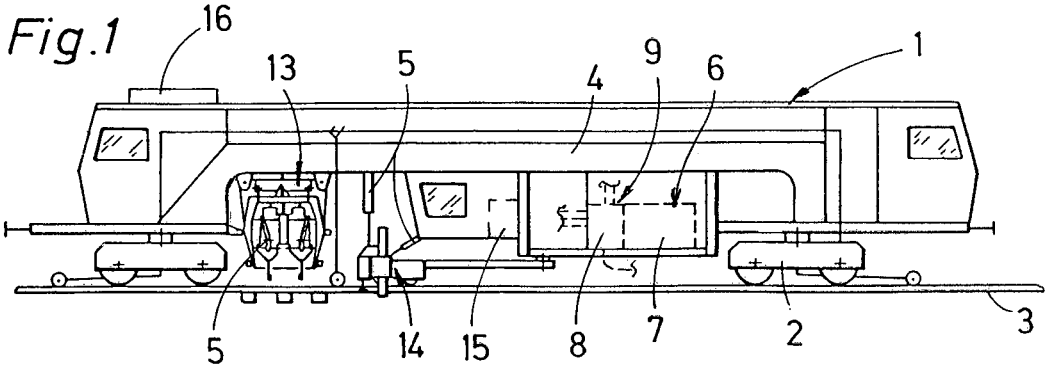
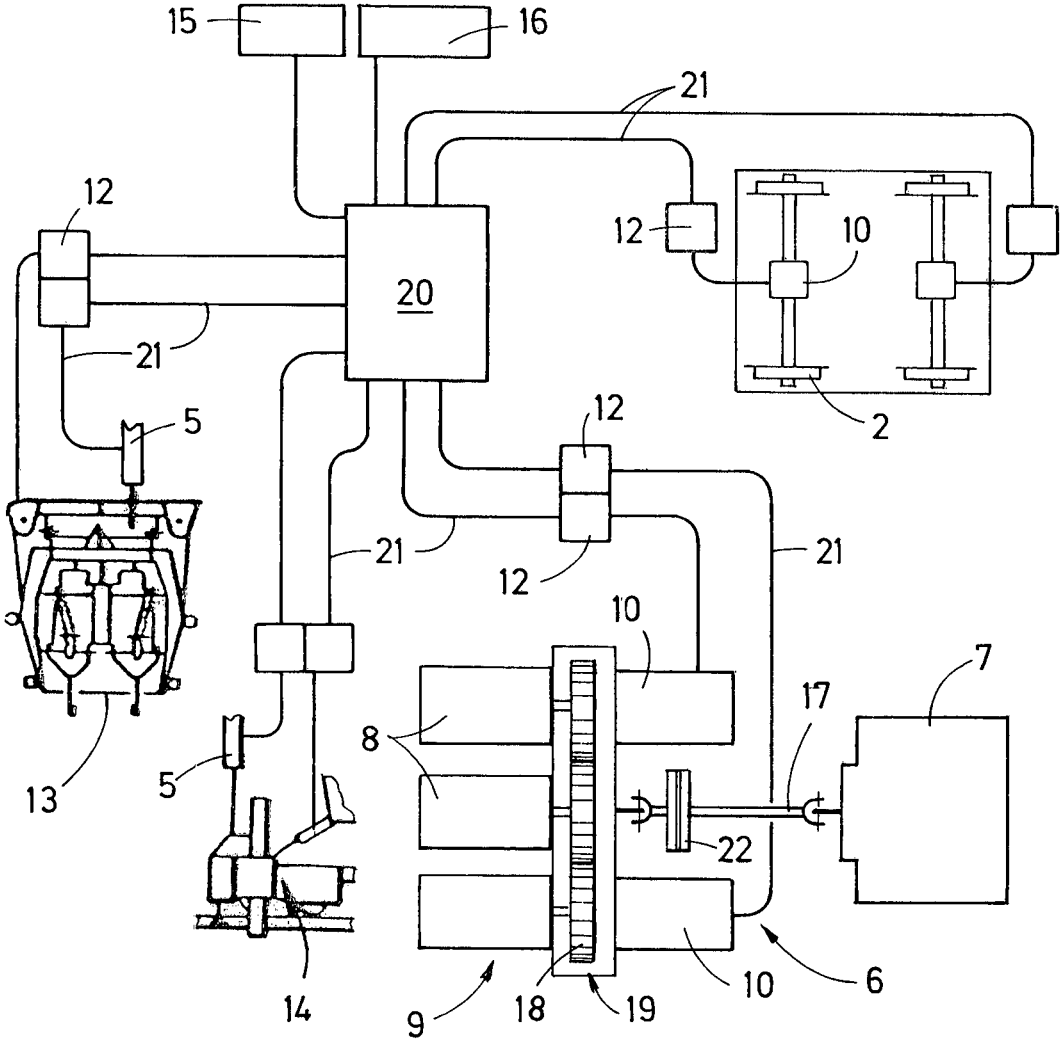
Fig. 2

TRACK MAINTENANCE MACHINE

BACKGROUND OF THE INVENTION

Field of the Invention

The invention relates to a track maintenance machine having a machine frame, mobile by means of on-track undercarriages on a track, and an energy supply system connected to a number of drives which is composed of a combustion engine and a hydraulic drive system comprising at least one hydraulic pump.

In many cases, the combustion engine of a track maintenance machine runs at full power even during a longer interruption of a working operation. This causes high fuel consumption as well as increased maintenance costs.

SUMMARY OF THE INVENTION

It is the object of the present invention to provide a track maintenance machine of the kind mentioned at the beginning with which it is possible to improve the energy balance required for operation of the machine.

According to the invention, this object is achieved with a track maintenance machine of the type mentioned at the beginning by way of the following features:

a) the combustion engine is mechanically connected by means of a drive shaft to an electric generator/motor unit, b) the generator/motor unit is connected by means of a drive unit to the hydraulic pump, c) a power accumulator is connected by means of an electrical supply line to the generator/motor unit and to the drives which can be actuated electrically.

By way of this combination of features, it is possible to supply various drives on the track maintenance machine mainly electrically. As far as hydraulic drives are required, the necessary hydraulic pumps can be driven via the generator/motor unit fed by the power accumulator. Thus, even a combustion engine with reduced performance can be sufficient, avoiding the disadvantages already cited with regard to the prior art.

Additional advantages of the invention become apparent from the dependent claim and the drawing description.

BRIEF DESCRIPTION OF THE SEVERAL VIEWS OF THE DRAWING

The invention will be described in more detail below with reference to an embodiment represented in the drawing.

FIG. 1 shows a side view of a track maintenance machine designed for tamping a track, and FIG. 2 shows a schematic top view of an on-track undercarriage, a drive unit and an energy supply system.

DESCRIPTION OF THE INVENTION

A track maintenance machine 1 is equipped with a machine frame 4, mobile by means of on-track undercarriages 2 on a track 3, and an energy supply system 6 connected to a number of different drives 5. Said energy supply system 6 is composed of a combustion engine 7, a hydraulic drive system 9 having hydraulic pumps 8, and two generator/motor units 10.

A tamping unit 13, equipped with numerous drives 5, and a track lifting unit 14 adjustable by hydraulic drives 5 are provided for correcting the position of the track. Various further electrical drives 5 for an air compressor 15 and an air conditioner 16 are indicated here only as examples.

The combustion engine 7 is mechanically connected to two electrical generator/motor units 10 by a drive shaft 17 and through a drive unit 19, designed here as the distribution gear 18.

Each generator/motor unit 10 is connected to the hydraulic pumps 8 via the drive unit 19.

A power accumulator 20 is connected by way of an electrical supply line 21 to the generator/motor units 10, to power converters 12 and to the drives 5 which can be actuated electrically. A generator/motor unit 10 connected to the power accumulator 20 is associated with the on-track undercarriage 2 as a motive drive.

In working operations, the combustion engine 7 drives both generator/motor units 10 via the distributor gear 18 with a nominal output of 150 KW each. The combustion engine 7 is equipped with a freewheel (or coupling) 22, so that the track maintenance machine 1 can thus operate also without the combustion engine 7. When the combustion engine 7 is started up, the generator/motor units 10 act as generators which charge the power accumulator 20 with a charging rate of 300 kW and/or—in transfer- or working mode—deliver the required power for the two generator/motor units 10 serving as motive drive. Additionally, continuation of the hydraulic system pressure when the combustion engine 7 is turned off is ensured in that one hydraulic pump 8 is driven by a generator/motor unit 10. When hydraulic drives 5 are actuated, energy supply to the same takes place by way of the hydraulic pumps 8.

In the case illustrated as an example, the lithium-ion-polymer accumulator has an output of 200 kW/h and, by way of the generator/motor units 10 driven by the combustion engine 7, can be charged to 80% of its storage capacity within about 25 minutes already. The system is designed in such a way that the various electrical drives 5 of auxiliary units also can be supplied with high voltage. Thus, a supply of the drives 5 is possible for an extended time without the need to start the combustion engine 7 for this purpose. In an advantageous manner, use of the combustion engine 7 in load operation can be limited to working operations. If the power accumulator 20 is fully charged, it can assume the supplying of energy partly even during working operations.

As an alternative to the shown example of a tamping machine, it is of course also possible to operate all other known track maintenance machines, such as a welding machine, for instance, by means of the energy supply system according to the invention.

The invention claimed is:

1. A track maintenance machine, comprising:

a machine frame;

on-track undercarriages for moving said machine frame on a track;

a plurality of electrically actuatable drives;

an energy supply system connected to said plurality of electrically actuatable drives, said energy supply system including a combustion engine and a hydraulic drive system having at least one hydraulic pump;

an electric generator/motor unit;

a drive shaft mechanically connecting said combustion engine to said electric generator/motor unit;

a mechanical drive unit connecting said generator/motor unit to said hydraulic pump;

a power accumulator; and an electrical supply line connecting said power accumulator to said generator/motor unit and to said electrically actuatable drives.

2. The track maintenance machine according to claim 1, wherein said generator/motor unit connected to said power accumulator is associated with said on-track undercarriage as a motive drive.

* * * * *